US010271134B2

(12) United States Patent
Douglas

(10) Patent No.: US 10,271,134 B2
(45) Date of Patent: Apr. 23, 2019

(54) 2D MATRIX ARRAY BACKING INTERCONNECT ASSEMBLY, 2D ULTRASONIC TRANSDUCER ARRAY, AND METHOD OF MANUFACTURE

(71) Applicant: COVARX CORPORATION, Apex, NC (US)

(72) Inventor: Stephen Douglas, Apex, NC (US)

(73) Assignee: COVARX CORPORATION, Apex, NC (US)

( * ) Notice: Subject to any disclaimer, the term of this patent is extended or adjusted under 35 U.S.C. 154(b) by 368 days.

(21) Appl. No.: 15/038,415

(22) PCT Filed: Nov. 21, 2014

(86) PCT No.: PCT/US2014/066871

§ 371 (c)(1),
(2) Date: May 20, 2016

(87) PCT Pub. No.: WO2015/077593

PCT Pub. Date: May 28, 2015

(65) Prior Publication Data

US 2016/0295319 A1 Oct. 6, 2016

Related U.S. Application Data

(60) Provisional application No. 61/907,787, filed on Nov. 22, 2013.

(51) Int. Cl.
*H04R 1/00* (2006.01)
*H04R 1/40* (2006.01)
(Continued)

(52) U.S. Cl.
CPC ..... *H04R 1/40* (2013.01); *B06B 1/0629* (2013.01); *H04R 17/00* (2013.01); *H04R 31/00* (2013.01); *H04R 2201/401* (2013.01)

(58) Field of Classification Search
USPC ..... 367/140
See application file for complete search history.

(56) References Cited

U.S. PATENT DOCUMENTS 5,722,137 A 3/1998 Lorraine et al.
5,764,485 A * 6/1998 Lebaschi ..... H01L 24/75 174/255

(Continued)

FOREIGN PATENT DOCUMENTS

JP 2000-166923 A 6/2000

*Primary Examiner* — James R Hulka
(74) *Attorney, Agent, or Firm* — Birch, Stewart, Kolasch & Birch, LLP

(57) ABSTRACT

Disclosed is a 2D Matrix Array Backing Interconnect Assembly that provides a structure that enables simple construction of complex wring for an ultrasonic transducer array of desired dimension. A backing interconnect assembly can be produced by forming a plurality of high density interconnect printed circuit boards, with layers each having a respective array of metal traces, wherein the metal traces are internally connected one-to-one to electrically conductive pads. An end of the metal traces are exposed at a surface to form respective conductive elements. High density interconnect printed circuit boards can be attached to a flexible printed circuit having contact pads that correspond to conductive pads of the printed circuit boards to form interconnect modules. The interconnect modules can be attached to form a backing interconnect assembly. The backing interconnect assembly with exposed conductive elements provides complex wiring interconnect for manufacture of small sized 2D ultrasonic transducer arrays.

9 Claims, 25 Drawing Sheets

(51) Int. Cl.

| | |
|---|---|
| ***H04R 17/00*** | (2006.01) |
| ***H04R 31/00*** | (2006.01) |
| ***B06B 1/06*** | (2006.01) |

(56) References Cited

U.S. PATENT DOCUMENTS

| | | | | |
|---|---|---|---|---|
| 5,847,936 | A * | 12/1998 | Forehand | H05K 1/114 174/250 |
| 6,043,590 | A | 3/2000 | Gilmore | |
| 6,336,269 | B1 * | 1/2002 | Eldridge | B23K 20/004 228/180.5 |
| 6,351,133 | B1 * | 2/2002 | Jones | G01R 1/06744 257/669 |
| 6,625,854 | B1 | 9/2003 | Sudol et al. | |
| 6,625,856 | B2 * | 9/2003 | Tezuka | B06B 1/0629 264/263 |
| 7,457,132 | B2 * | 11/2008 | Gisin | H05K 1/023 174/260 |
| 8,388,337 | B2 * | 3/2013 | Ouriev | A23G 1/206 137/845 |
| 8,456,856 | B2 * | 6/2013 | Lin | H01L 23/60 257/686 |
| 2001/0044995 | A1 | 11/2001 | Tezuka | |
| 2003/0085635 | A1 | 5/2003 | Davidsen | |
| 2007/0091581 | A1 * | 4/2007 | Gisin | H05K 1/023 361/782 |
| 2009/0053376 | A1 * | 2/2009 | Ouriev | A23G 1/206 426/516 |
| 2010/0246152 | A1 * | 9/2010 | Lin | H01L 21/563 361/783 |
| 2015/0296607 | A1 * | 10/2015 | Yang | G01L 1/205 361/750 |

* cited by examiner

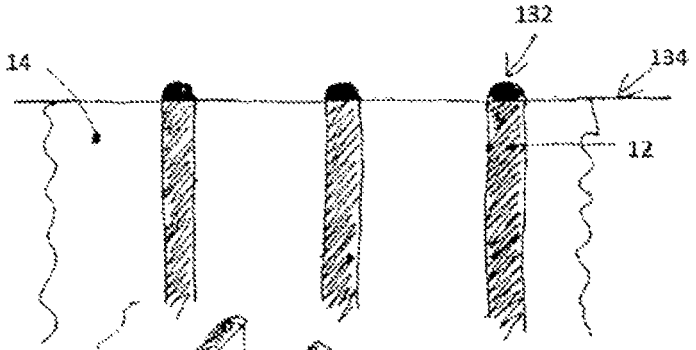
FIG. 9A
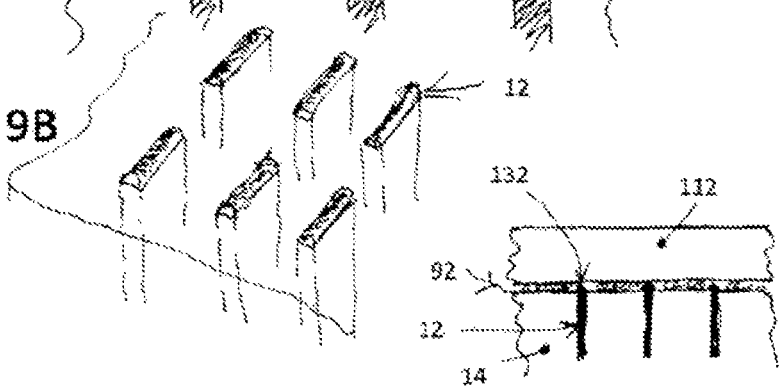
FIG. 9B
FIG. 9C

2D MATRIX ARRAY BACKING INTERCONNECT ASSEMBLY, 2D ULTRASONIC TRANSDUCER ARRAY, AND METHOD OF MANUFACTURE

CROSS REFERENCE TO RELATED APPLICATIONS:

This application is the National Phase of PCT/US2014/066871 filed on Nov. 21, 2014, which claims priority under 35 U.S.C 119(e) to U.S. Provisional Application No. 61/907,787 filed on Nov. 22, 2013 , all of which are hereby expressly incorporated by reference into the present application.

BACKGROUND OF THE DISCLOSURE

Field of the Disclosure

Aspects of the present disclosure relate to methods of manufacturing two dimensional matrix array backing interconnect assemblies formed of stacked high density interconnect printed circuit boards and flexible printed circuits that can be interconnected with acoustic materials to form two dimensional ultrasonic transducer arrays.

Description of Related Art

Ultrasonic imaging has been utilized for a number of years in the medical field. Linear and curvilinear ultrasonic transducers are used to produce visual images of features within a patient's body. Such ultrasonic imaging transducers are also used in other fields.

Typically, an ultrasonic transducer for producing visual images of features inside the body includes an array of ultrasonic elements which may be driven by a desired excitation and/or receive ultrasonic reflections obtained from various features of interest.

As technology progresses, there has been an increasing need to produce ultrasonic images having enhanced resolution. There is also, a desire to produce ultrasonic transducers producing not only better images, but exhibiting greater reliability and ease of manufacture.

In a conventional ultrasonic transducer array, a piezoelectric assembly is fastened to a backing, and the piezoelectric assembly is then cut transversely into individual electrode elements extending along a longitudinal direction.

One of the limiting factors in manufacturing such piezoelectric ultrasonic transducers is that, as transducer elements size decreases, there is an increased difficulty in constructing complex wiring that is needed for ultrasonic transducers which can have hundreds of piezoelectric elements.

BRIEF SUMMARY OF THE DISCLOSURE

An aspect of the disclosure is a method of producing a two dimensional matrix array backing interconnect assembly. A disclosed method includes steps of forming a plurality of high density interconnect printed circuit boards, each high density interconnect printed circuit board having a plurality of alternating layers of a dielectric layer and a lamination material, each dielectric layer having an array of metal traces, wherein a two dimensional matrix of electrically conductive pads is formed on an outermost surface of the high density interconnect printed circuit board that is parallel to an array of the metal traces, wherein the metal traces are internally connected one-to-one to each of the electrically conductive pads by way of electrically conductive through-holes, wherein an end of the metal traces are exposed at a surface of the alternating layers to form respective conductive elements;

forming a plurality of flexible printed circuits, each flexible printed circuit having at least one two dimensional array of electrically conductive pads, wherein one of the two dimensional matrix of pads corresponds one-to-one to the two dimensional matrix of electrically conductive pads is formed on the outermost surface of one of the high density interconnect printed circuit boards, each flexible printed circuit having at least one secondary two dimensional array of electrically conductive pads in a section of the flexible printed circuit that is separate from a section having the at least one two dimensional array of electrically conductive pads;

attaching one flexible printed circuit to a first one high density interconnect printed circuit board so that the corresponding two dimensional matrix of pads line up one-to-one;

repeating the attaching of one flexible printed circuit to one high density interconnect printed circuit board for each of the plurality of flexible printed circuits and each of the plurality of the high density interconnect printed circuit boards to form interconnect modules; and attaching the interconnect modules to form a two dimensional matrix array backing interconnect assembly.

The method further includes that the attaching is attaching a second one said high density interconnect printed circuit board to an opposite side of the one flexible printed circuit, opposite to the side that the first one high density interconnect printed circuit board has been attached, the attaching being such that one flexible printed circuit is attached to the second one high density interconnect printed circuit board so that the corresponding two dimensional matrix of pads line up one-to-one with respect to a two dimensional matrix of pads formed on the opposite side of the one flexible printed circuit; and the step of repeating the attaching for each of the plurality of flexible printed circuits and each of the plurality of the high density interconnect printed circuit boards to form interconnect modules each having one flexible printed circuit with two high density printed circuit boards attached thereto.

The method further includes that the attaching one flexible printed circuit to a first one the high density interconnect printed circuit board being performed by applying a conductive adhesive.

The method further includes that the attaching one flexible printed circuit to a first one high density interconnect printed circuit board being performed by an ohmic connection between corresponding pads.

An aspect of the disclosure is a method of producing a two dimensional ultrasonic transducer array, including forming a plurality of high density interconnect printed circuit boards, each high density interconnect printed circuit board having a plurality of alternating layers of a dielectric layer and a lamination material, each dielectric layer having an array of metal traces, wherein a two dimensional matrix of electrically conductive pads is formed on an outermost surface of the high density interconnect printed circuit board that is parallel to an array of the metal traces, wherein the metal traces are internally connected one-to-one to each of the electrically conductive pads by way of electrically conductive through-holes, wherein an end of the metal traces are exposed at a surface of the alternating layers to form respective conductive elements;

forming a plurality of flexible printed circuits, each flexible printed circuit having at least one two dimensional array of electrically conductive pads, wherein one of the two dimensional matrix of pads corresponds one-to-one to the two dimensional matrix of electrically conductive pads is formed on the outermost surface of one of the high density interconnect printed circuit boards, each flexible printed circuit having at least one secondary two dimensional array of electrically conductive pads in a section of the flexible printed circuit that is separate from a section having the at least one two dimensional array of electrically conductive pads;

attaching one flexible printed circuit to a first one high density interconnect printed circuit board so that the corresponding two dimensional matrix of pads line up one-to-one;

repeating the attaching of one flexible printed circuit to one high density interconnect printed circuit board for each of the plurality of flexible printed circuits and each of the plurality of the high density interconnect printed circuit boards to form interconnect modules;

attaching the interconnect modules to form a two dimensional matrix array backing interconnect assembly;

applying a backing layer, made of a material having a higher acoustic impedance than the two dimensional matrix array backing interconnect assembly, on a surface of the two dimensional matrix array backing interconnect assembly having the exposed conductive elements of the metal traces;

applying a piezoelectric layer on the backing layer; and applying one or more acoustic matching layers on the piezoelectric layer to form a two dimensional ultrasonic transducer array.

The method of producing a two dimensional ultrasonic transducer array, further includes that in the applying the backing layer, producing plated bumps on the exposed conductive elements of the metal traces in order to form conductive protrusions for the metal traces, cutting shallow slots through the center of each row of metal traces through the conductive protrusions, and using a tongue and groove technique, applying the backing layer on the surface of the two dimensional matrix array backing interconnect assembly having the exposed conductive elements of the metal traces.

The method of producing a two dimensional ultrasonic transducer array, further includes cutting slots in between metal traces through the acoustic matching layers, the piezoelectric layer, the backing layer and into the 2D matrix array backing interconnect assembly, to a depth sufficient to extend electrical isolation between individual metal traces to the uppermost surface of the 2D ultrasonic transducer array, to form a 2D array of ultrasonic transducers.

The method of producing a two dimensional ultrasonic transducer array, further includes that the one or more acoustic matching layers are applied to the piezoelectric layer to form an acoustic stack that is attached as a unit to the backing layer.

The method of producing a two dimensional ultrasonic transducer array, further includes that each high density interconnect printed circuit board is formed such that an end of the metal traces at each row parallel to the surface of an attached flexible printed circuit are exposed only in a center column, and form a radial arrangement in depth from the surface in both directions along each array of metal traces beginning at the center column, machining the surface to form a radial surface that exposes ends of the arrays of metal traces, applying the backing layer, the piezoelectric layer, and the one or more acoustic matching layers to form a curvilinear transducer array.

An aspect of the present disclosure is a two dimensional ultrasonic transducer that includes a plurality of stacked layers each including,

- a generally planar insulative substrate,
- a plurality of conductive parallel acoustic elements connections extending at an end thereof to an edge of each insulative substrate,
- an acoustic element connected to the end of each acoustic element connection;

plural signal connecting electrical interconnects extending generally transversely of the insulative substrates, at least some of the plural signal connecting electrical interconnects extending through one or more generally planar insulative substrates to pass signals to or from the acoustic elements;

at least one insulative interconnect substrates having conductive paths formed thereon and connecting to the plural signal connecting electrical interconnects from exterior of the ultrasonic transducer.

The two dimensional ultrasonic transducer further includes that the conductive parallel acoustic elements connections and the generally planar insulative substrates are printed circuit boards.

The two dimensional ultrasonic transducer further includes that the insulative interconnect substrate is a flexible printed circuit.

The two dimensional ultrasonic transducer further includes an acoustic stacked layer including a layer of piezoelectric material, the acoustic stacked layer mounted on the ends of the plurality of conductive parallel acoustic elements.

The two dimensional ultrasonic transducer further includes that the acoustic electrodes have a pitch in an direction parallel to the edge of each insulative substrate; with the pitch between adjacent parallel acoustic elements defining the electrode pitch in the direction parallel to the insulative substrates.

The two dimensional ultrasonic transducer further includes that the acoustic electrodes have a pitch in the direction generally perpendicular to the plane of each insulative substrate, with the pitch between adjacent parallel acoustic elements in the direction transverse to the insulative substrates.

The two dimensional ultrasonic transducer further includes that the acoustic elements are formed of a sheet of acoustic material overlaid across the ends of the plurality of conductive parallel acoustic elements and diced into individual elements corresponding to each of the conductive parallel acoustic element connections.

BRIEF DESCRIPTION OF THE SEVERAL VIEWS OF THE DRAWINGS

Having thus described the disclosure in general terms, reference will now be made to the accompanying drawings, which are not necessarily drawn to scale.

Figure 1:
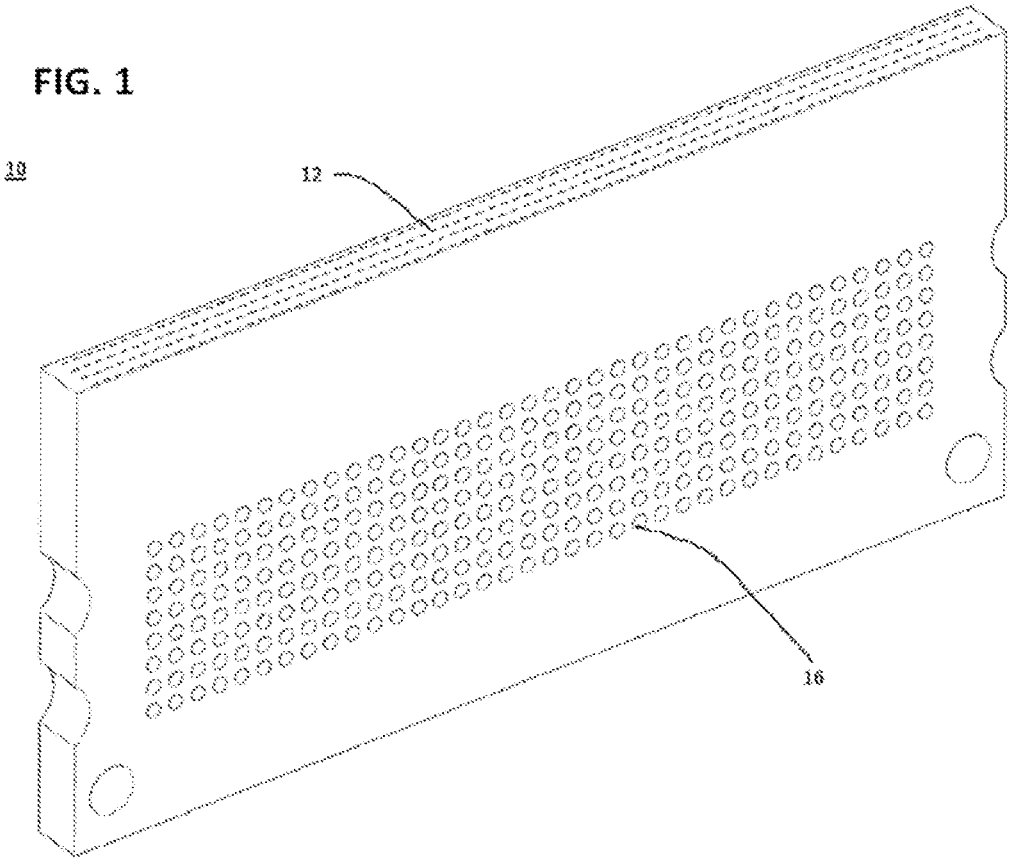
Figure 2:
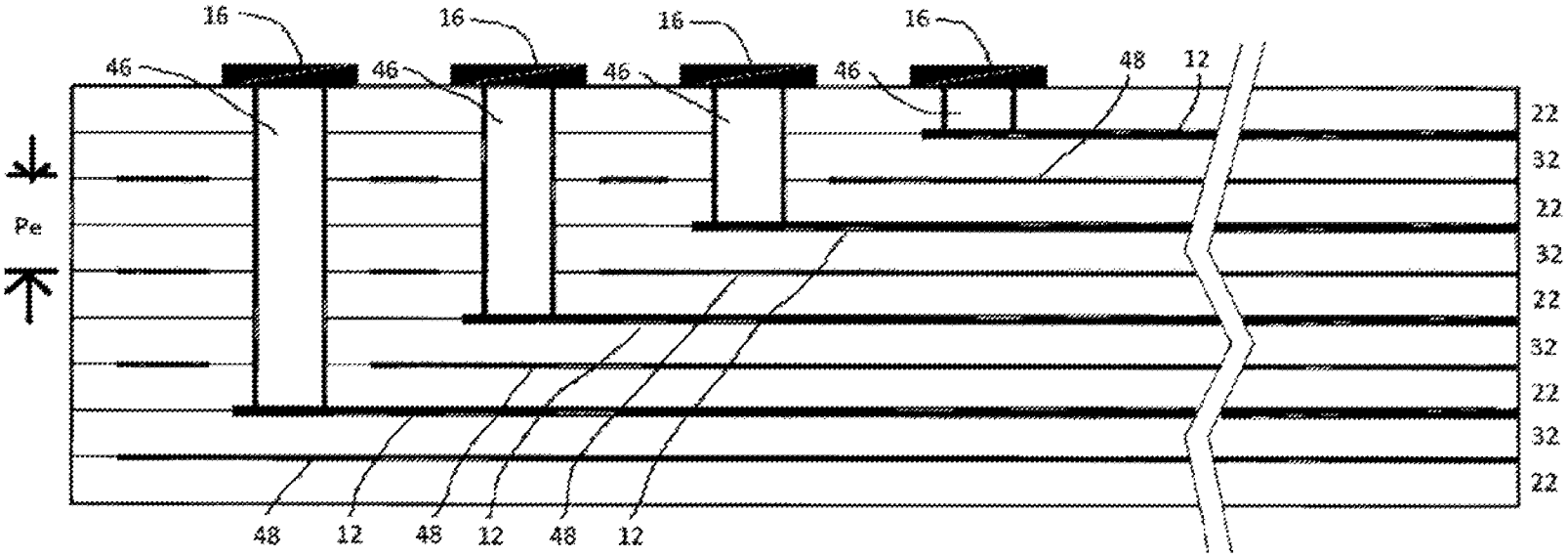
Figure 3:
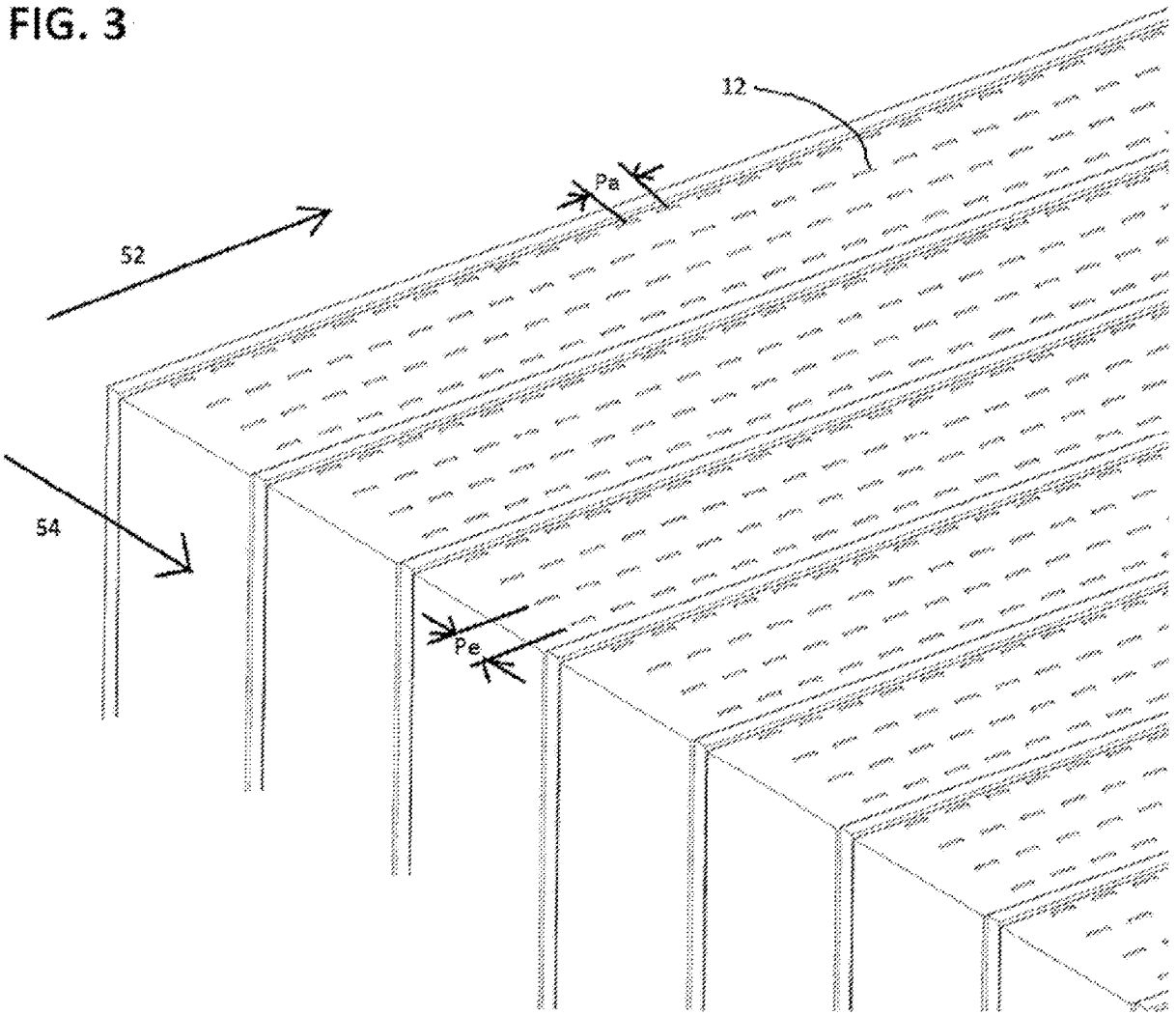
Figure 4A:
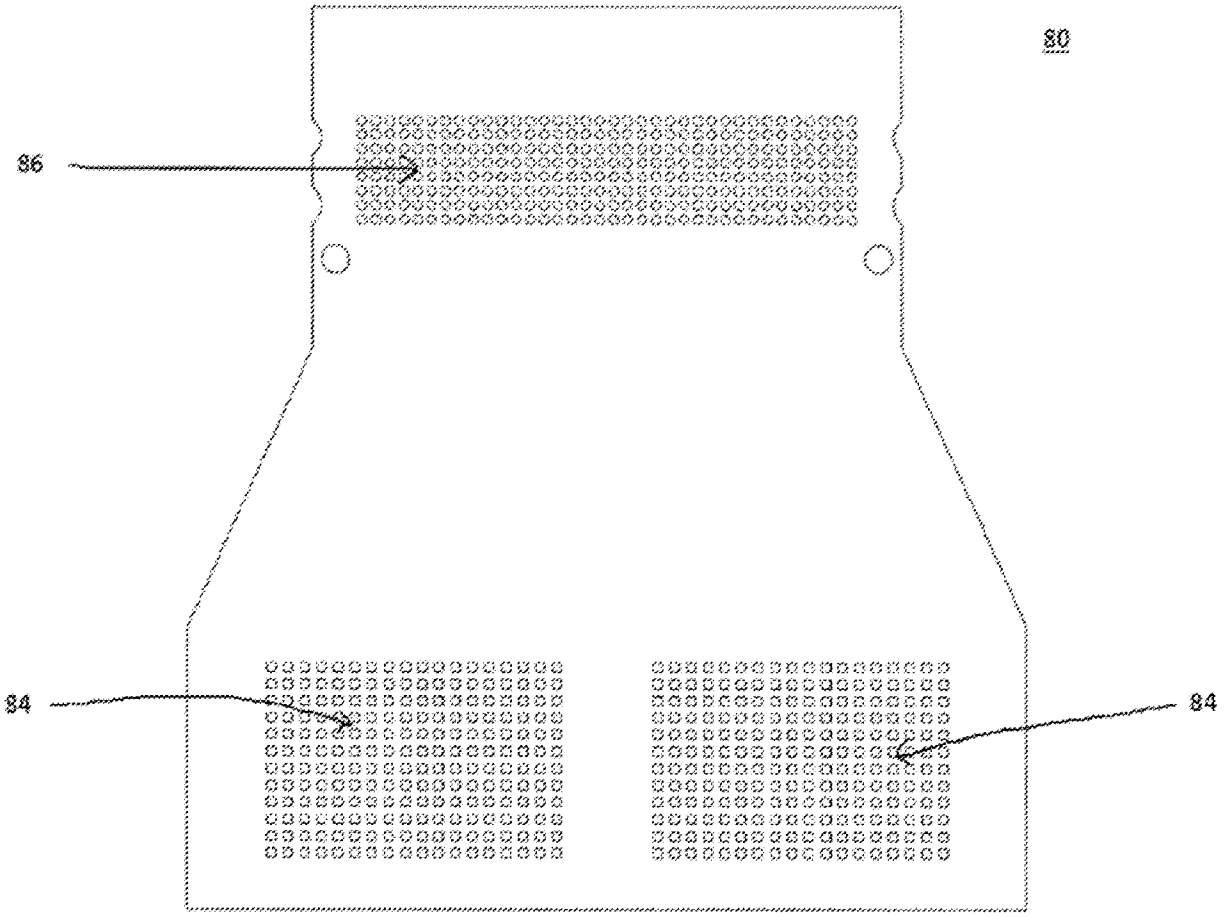
Figure 4B:
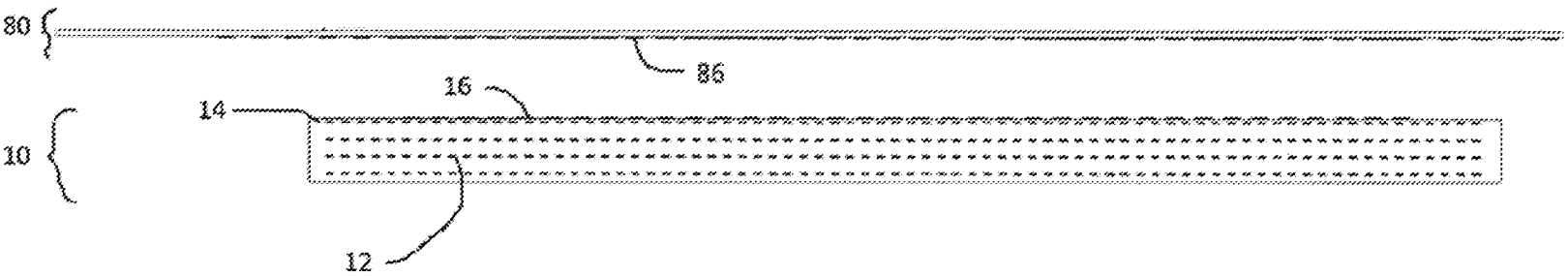
Figure 4C:
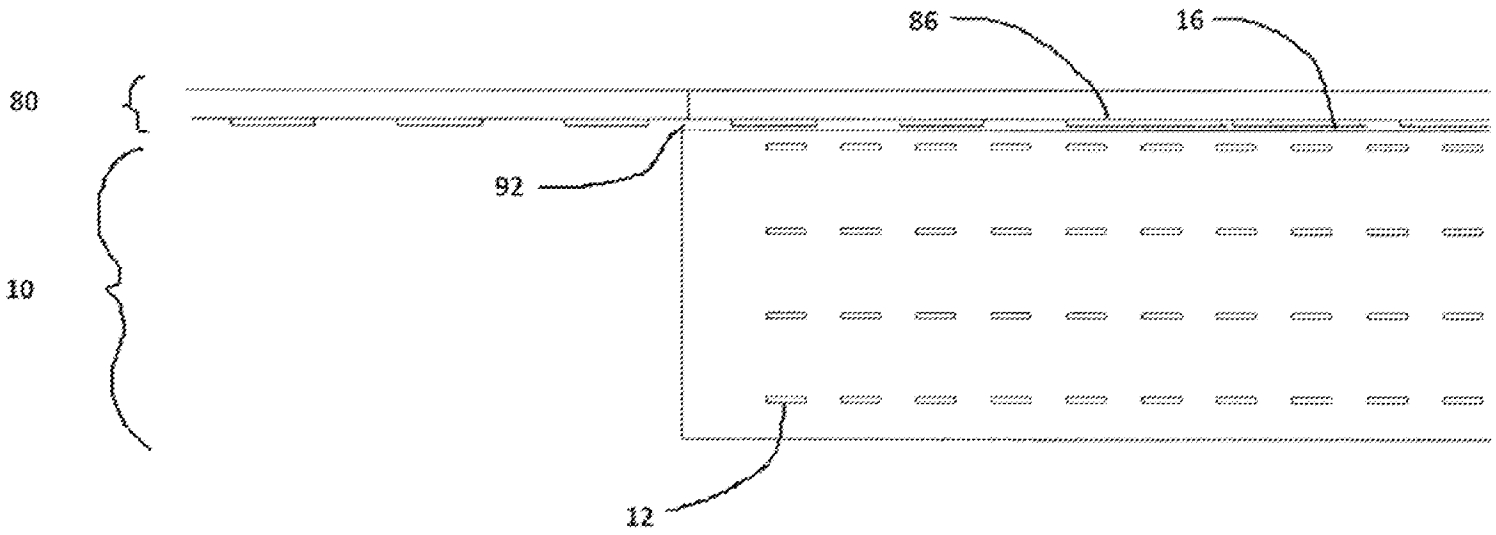
Figure 5A:
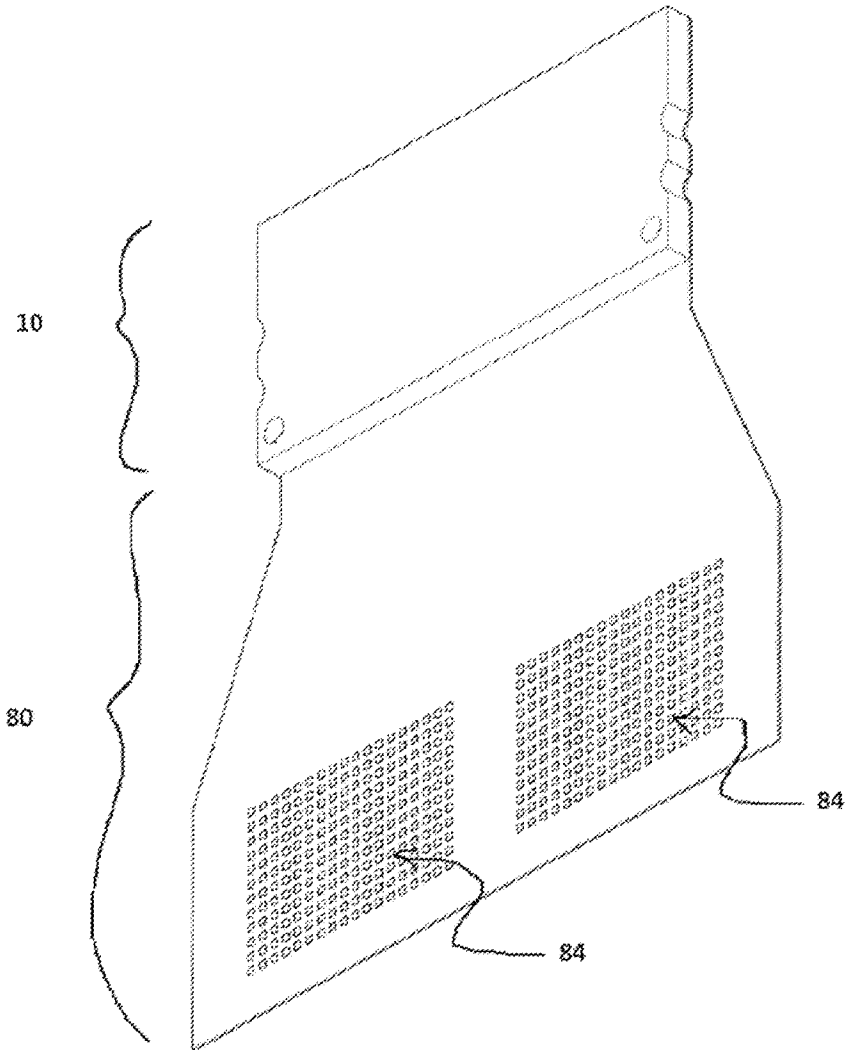
Figure 5B:
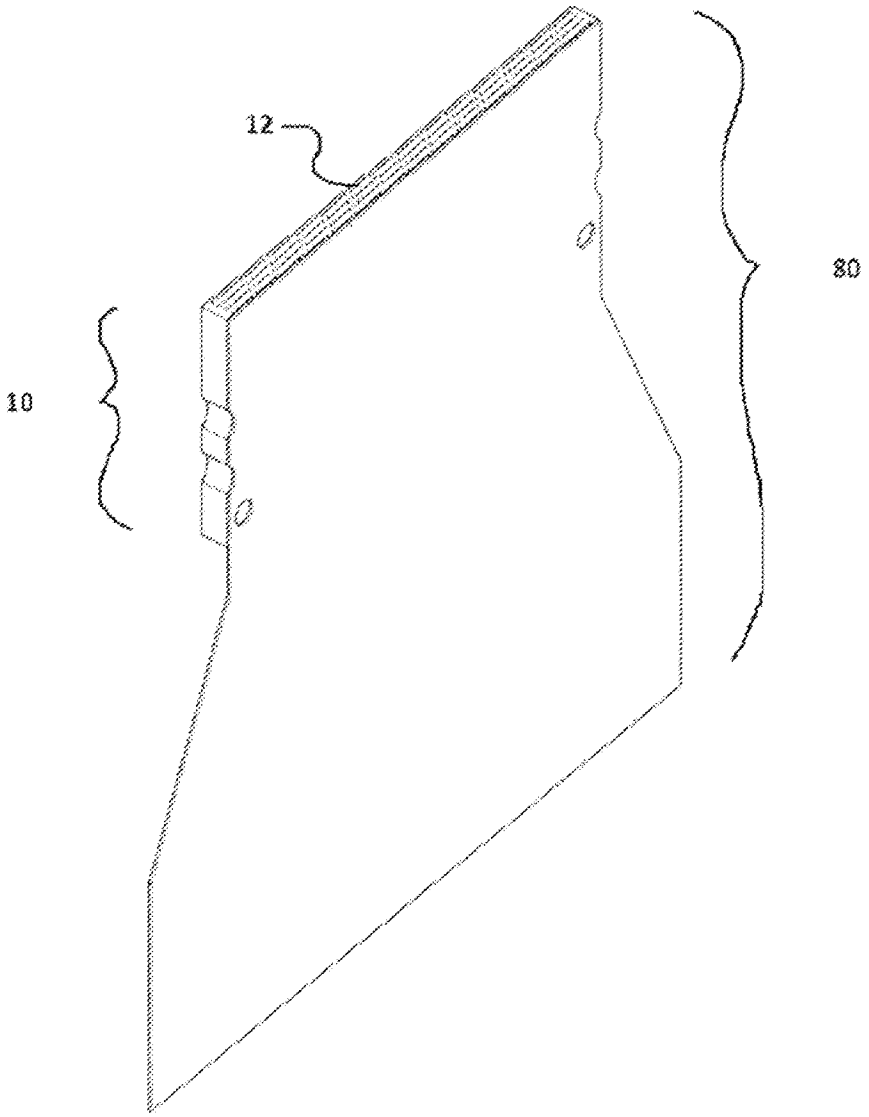
Figure 5C:
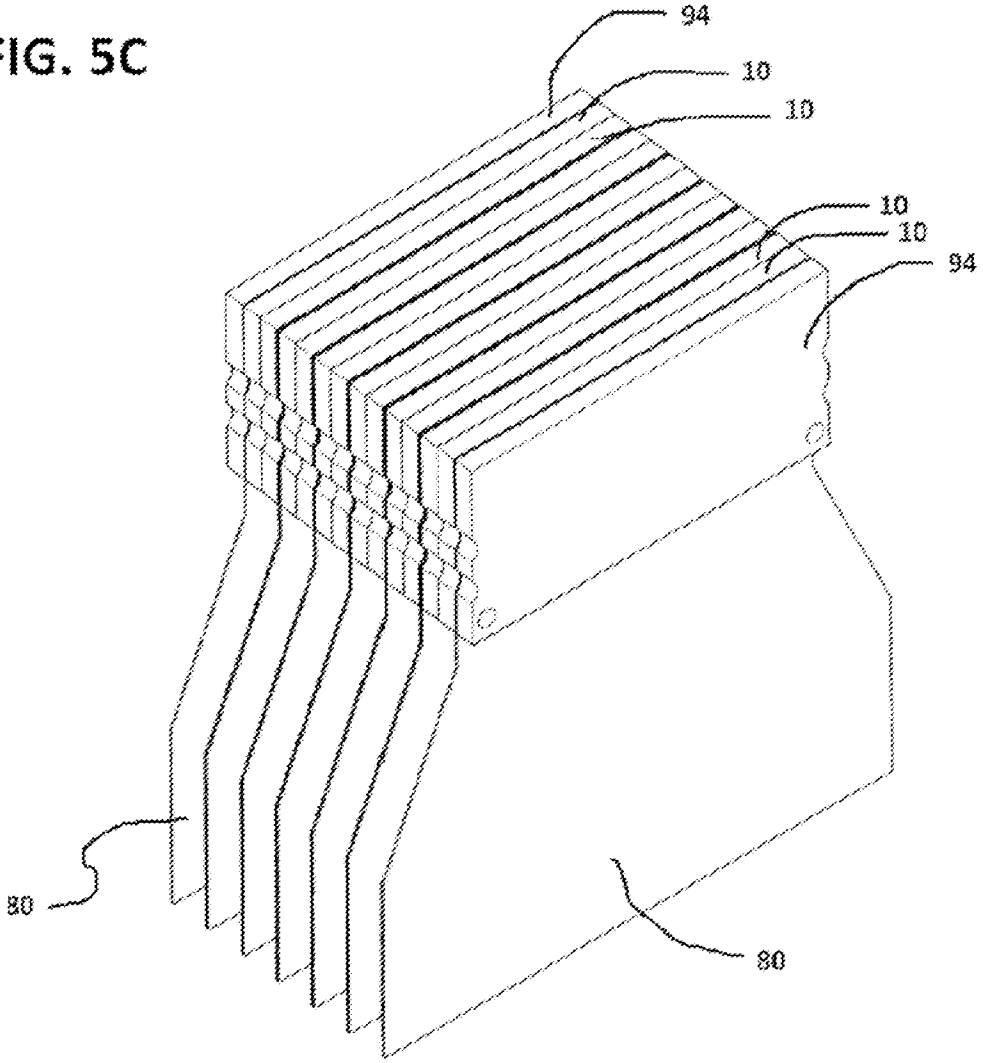
Figure 6:
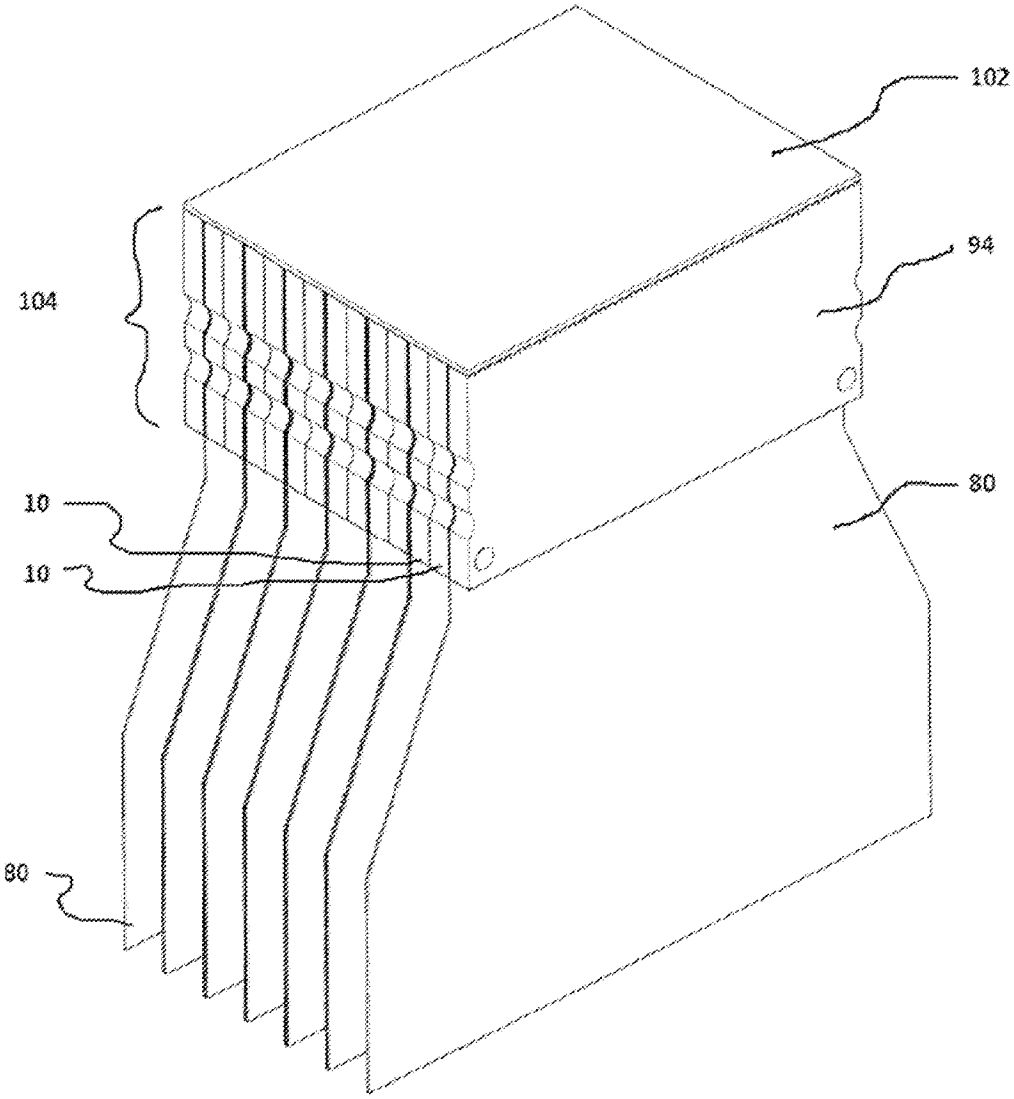
Figure 7A:
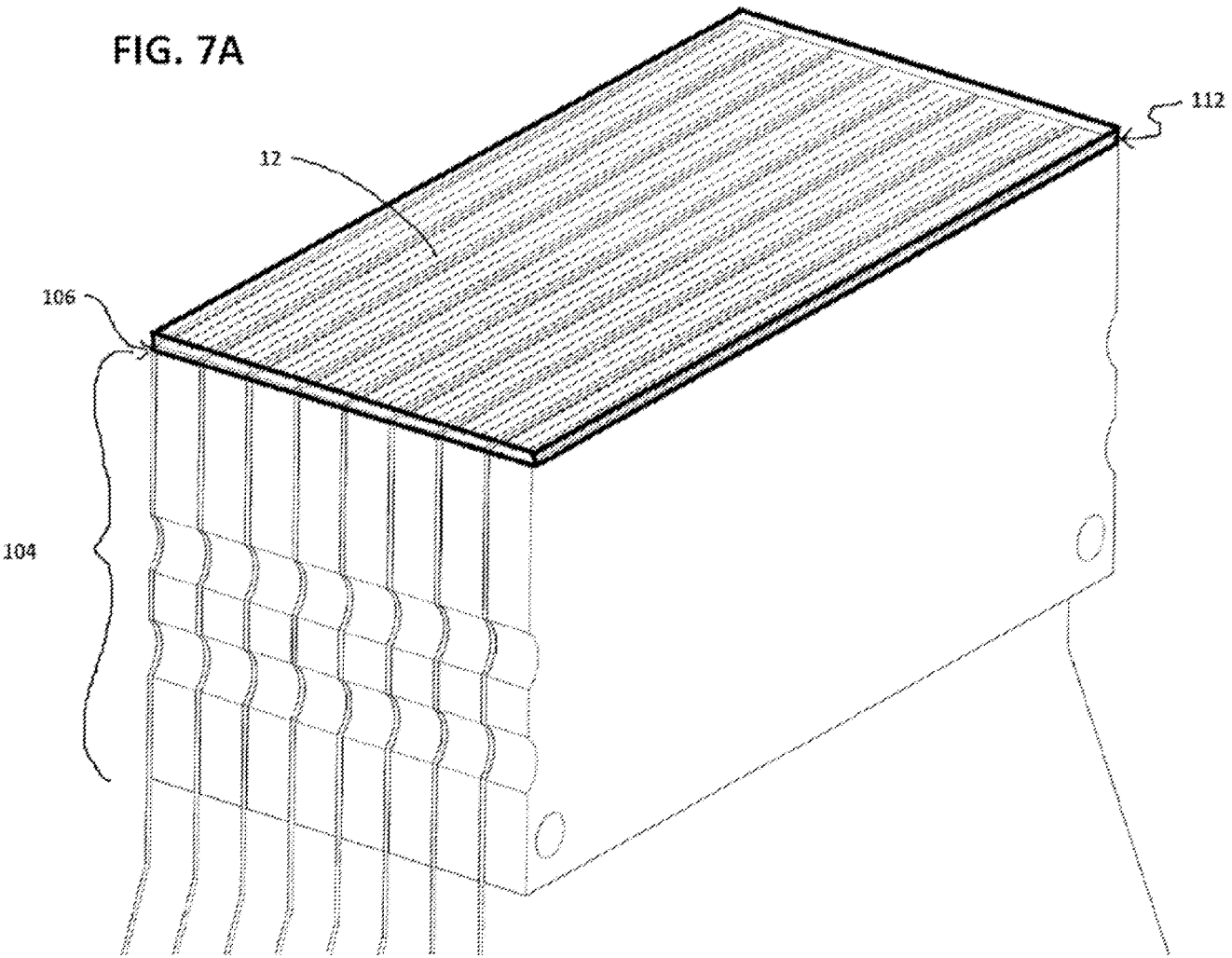
Figure 7B:
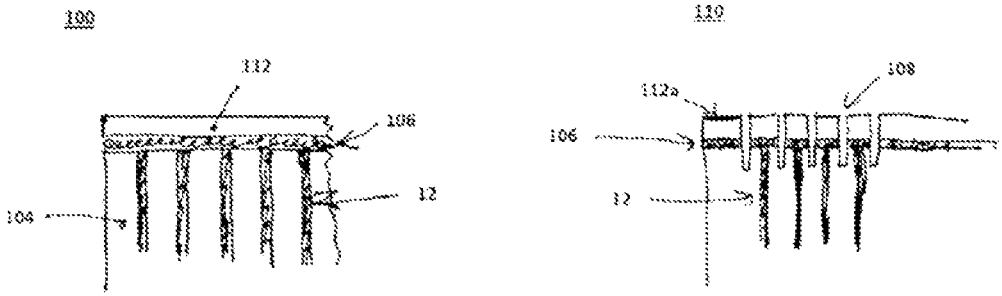
Figure 10:
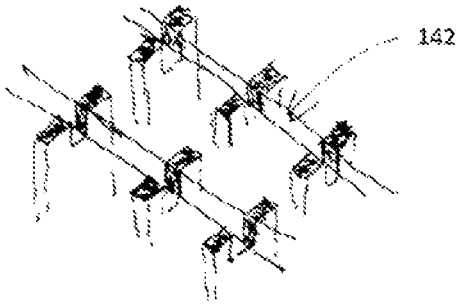
Figure 11:
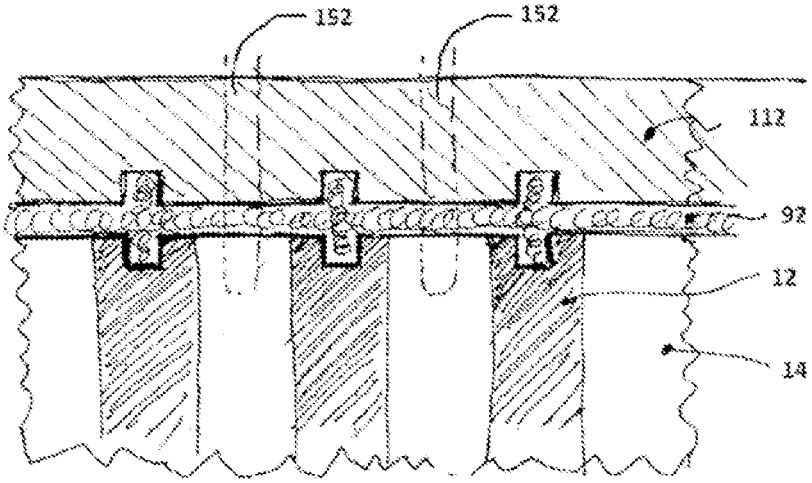
Figure 12:
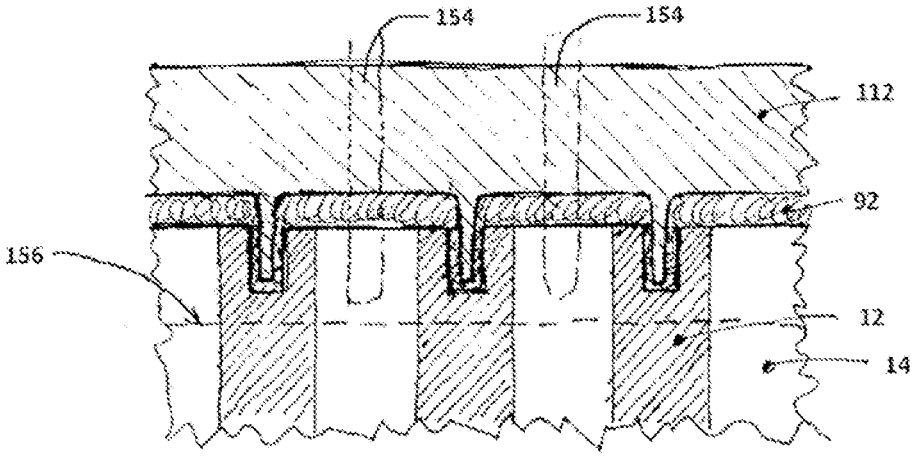
Figure 13A:
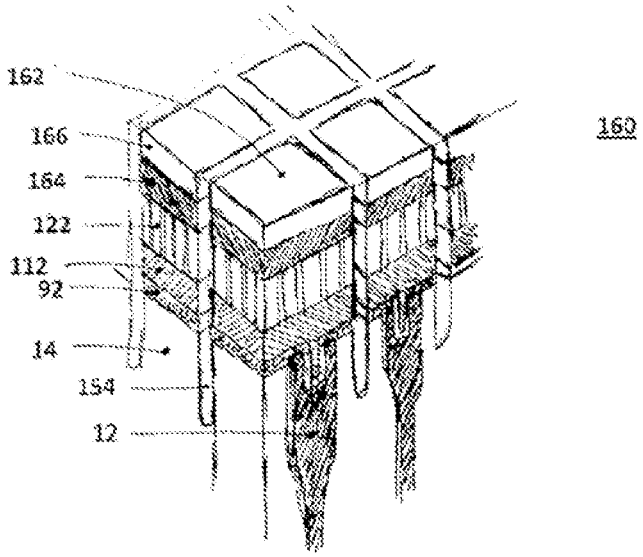
Figure 13B:
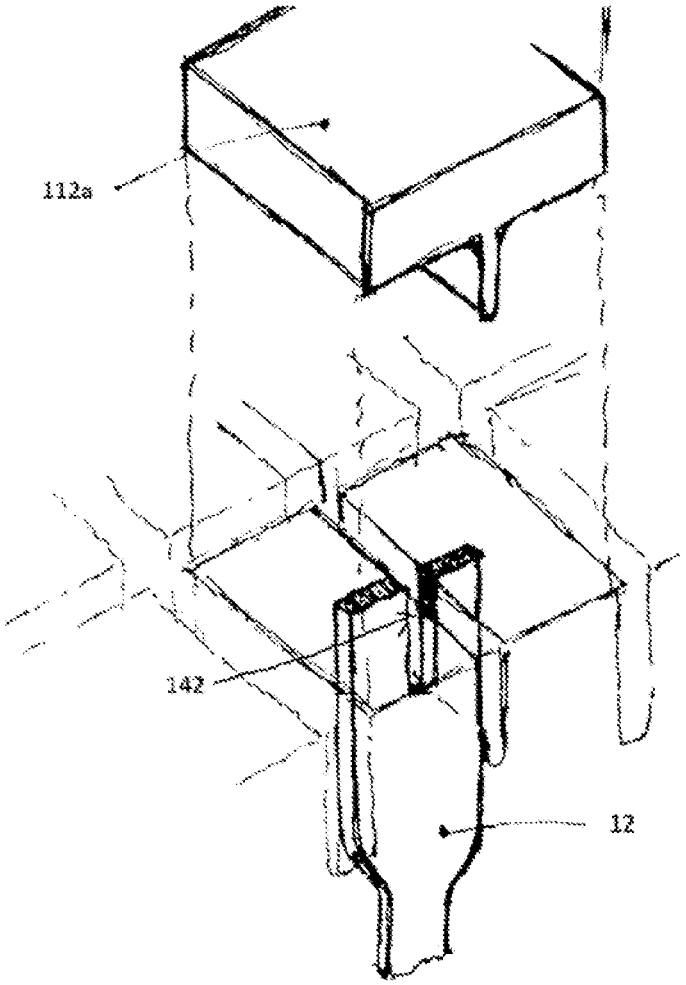
Figure 14A:
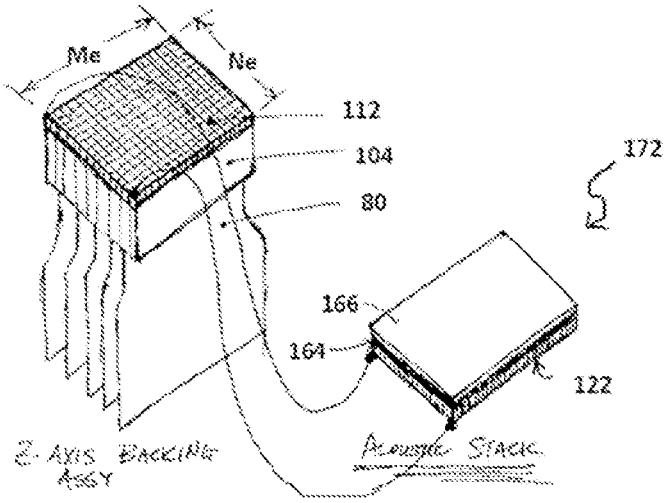
Figures 14B, 14C:
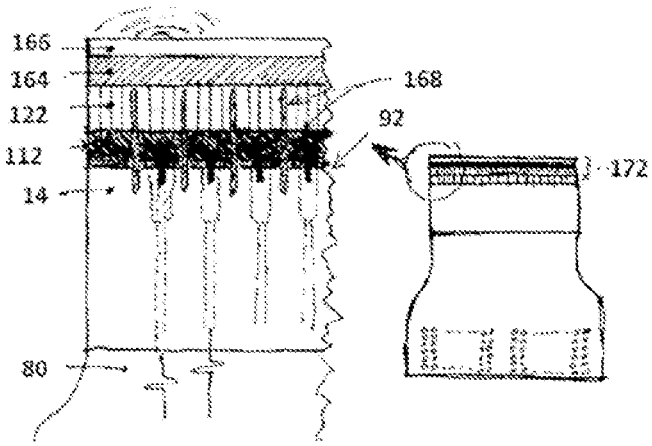

FIG. 1 illustrates a perspective view of a HDI PCB for forming a 2D matrix array backing, according to a first embodiment of the disclosure;

FIG. 2 illustrates a cross-section view of the HDI PCB, according to the first embodiment of the disclosure;

FIG. 3 illustrates azimuthal and elevation pitch in the HDI PCB, according to the first embodiment of the disclosure;

FIGS. 4A, 4B, and 4C illustrate steps in connecting a Flexible Printed Circuit to the HDI PCB, according to the first embodiment of the present disclosure;

FIGS. 5A, 5B, and 5C illustrate forming a 2D matrix array backing as a stack of Flexible Printed Circuits and HDI FCB assemblies, according to the first embodiment of the present disclosure;

FIG. 6 illustrates a 2D matrix array backing having a high acoustic impedance backing layer, according to the first embodiment of the present disclosure;

FIGS. 7A and 7B illustrate dicing a 2D matrix array backing into a matrix of pads, according to a second embodiment of the present disclosure;

FIGS. 8A, 8B, 8C, and 8D illustrate steps in forming an acoustic stack on the 2D matrix array backing, according to a third embodiment of the present disclosure;

FIGS. 9A, 9B, and 9C illustrate a step of forming plated bumps on the backing, according to a fourth embodiment of the present disclosure;

FIG. 10 illustrates a step of cutting slots through traces in the backing, according to the fourth embodiment of the present disclosure;

FIG. 11 illustrates a step of cutting slots in the backing, according to the fourth embodiment of the present disclosure;

FIG. 12 illustrates a step of forming tongue and groove between the backing and the high impedance backing layer, according to the fourth embodiment of the present disclosure;

FIGS. 13A and 13B illustrate a cross-section view of the 2D matrix array acoustic module as a result of the tongue and groove method, according to the fourth embodiment of the present disclosure;

FIGS. 14A, 14B, and 14C illustrate a 2D matrix array acoustic module formed by attaching an acoustic stack to a Z-axis backing, according to a fifth embodiment of the present disclosure; and FIGS. 15A, 15B, 15C, and 15D illustrate steps in forming a curvilinear transducer, according to a sixth alternative embodiment of the present invention.

DETAILED DESCRIPTION OF THE DISCLOSURE

The present disclosure will be described more fully with reference to the accompanying drawings. The drawings represent example aspects of the present invention. However, other aspects are possible and the present invention should not be limited to the aspects set forth herein. Like reference numbers refer to like elements throughout.

Ultrasonic transducer arrays can be manufactured as a dense array of piezoelectric elements each independently connected to wiring for either obtaining an electric signal from a piezoelectric element, or providing an electric signal to a piezoelectric element. The ultrasonic transducer array is capable of transmitting a sound signal from each piezoelectric element or receiving a sound signal and converting the sound signal into an electric signal. In the present disclosure, the wiring is constructed as a 2D Matrix Array Backing Interconnect Assembly.

Disclosed embodiments of a 2D Matrix Array Backing Interconnect Assembly provide a structure that enables simple construction of complex wring for an ultrasonic transducer array of desired dimension. An example is provided that makes electrical contact to pads (element and ground) on the front (or back) side of a Printed Circuit Board (PCB) and a Flexible Printed Circuit (FPC) such that all the electrical connections to the elements can be read out to another circuit PCB that will be either or both electrical circuits and cables.

[First Embodiment]

Disclosed embodiments provide for stacking of as many PCB/FPC modules as needed to form a 2D Matrix Array Backing Interconnect Assembly. High Density Interconnect (HDI) PCB's are provided in which the distance between metal contacts can be set to a desired elevation pitch. FIGS. 1 to 5 show steps that can be performed in manufacturing a 2D Matrix Array Backing Interconnect Assembly.

FIG. 1 illustrates a perspective view of a HDI PCB. FIG. 2 illustrates a cross-section view of the HDI PCB of FIG. 1. FIG. 3 illustrates azimuthal and elevation pitch in the HDI PCB. FIGS. 4A, 4B, and 4C illustrate steps in connecting a Flexible Printed Circuit to the HDI PCB. FIGS. 5A, 5B, and 5C illustrate the formation of a 2D Matrix Array Backing Assembly by stacking modules having a Flexible Printed Circuit and one or more HDI FCB.

In the HDI PCB 10 shown in FIG. 1, a two-dimensional array with m×n elements for connection to an array of ultrasonic elements is provided by way of exposed elements for internal Metal Traces 12 that interconnect between the elements and an array of Pads 16 for connection to a FPC or cable PCB/FPC. The ultrasonic elements, as will be described later, can be piezoelectric elements that are capable of converting an electric signal to a sound signal, or converting a sound signal to an electric signal.

FIG. 2 shows a cross-section view of the HDI PCB of FIG. 1. Dielectric layers 32 made of a core material space Metal Traces 12 apart. An array of Metal Traces 12 can be formed on each dielectric layer, and thus arrays of the Metal Traces 12 can be spaced by a desired elevation pitch Pe. Conductive through-holes or blind Vias 46 (of conductive material) connect Pads 16 to internal Metal Traces 12. A laminating material 22 made of a pre-peg material is applied to each surface having the Metal Traces 12, as well as to an outer surface of the HDI PCB. The dielectric layer material and the laminating material can be of a material having the same dielectric properties. In an example embodiment, the dielectric layer material and the laminating material are made with polyimide material, which is conventionally used to make flexible circuits. Internal ground layers 48 (Metal) are provided for each respective Metal Trace 12. In example embodiments, the Metal Traces 12 and internal ground layers 48 are Cu. Although FIG. 2 shows four Metal Traces 12 and associated Pads 16, the number of metal traces are only limited by the dimensions of the HDI PCB and desired elevation pitch. Also, one side of the HDI PCB or both sides can have an array of Pads 16 that connect to internal Metal Traces 12.

As can be seen in FIG. 2, in order to connect Vias 46 to each Metal Trace 12, the length of Metal Traces 12 in an array extends farthest along a dielectric layer 32 at a farthest Dielectric layer 32 that is connected to Pads 16, and Metal Traces 12 in higher Dielectric layers are shorter by an amount sufficient for Vias 46 to reach the adjacent lower array of Metal Traces 12. In other words, the arrangement of arrays of Metal Traces 12 is a stepped arrangement, beginning from an array of Metal Traces 12 that is formed with Vias 46 for a first row (where a row is in a direction perpendicular with respect to the view shown in the drawing).

As can be seen in FIG. 3, by stacking many PCB's 14 together, many combinations of arrays of traces 12 can be formed into matrices of Traces. The PCB 14 circuit layers can have Metal Traces 12 laid out in a desired Azimuthal Pitch Pa which extends along an Azimuth Direction 52 to the edges of a PCB. Elevation Pitch Pe can be set as a distance between metal traces 12 in the elevation direction 54.

FIGS. 4A to 4C show steps in attaching an HDI PCB 10 to a FPC 80. As shown in FIG. 4A, Flexible Printed Circuit (FPC) 80 is formed with an array of Pads 86 that are arranged to correspond to Pads 16 of a HDI PCB 10. Pads 84 are provided for electronic or cable connection to a PCB. The contact between the PCB Pads 16 and FPC Pads 86 can be made using techniques, such as ohmic connection or with a conductive adhesive. In a disclosed embodiment, the contact is made using an anisotropic conductive film or paste 92. FIG. 4B shows the arrangement of the HDI PCB 10 and FPC 80 as seen from a top view before attachment. FIG. 4C shows the same top view where the HDI PCB 10 is mounted to the FPC 80 with anisotropic conductive film or paste 92, after applying heat and pressure. One-to-one contact is made between Pads 16 and Pads 86. Although it is preferred that contact be made between all Pads 16 and all Pads 86, it is possible to mount a HDI PCB 10 to a FPC 80 that has fewer Pads 86 than the number of Pads 16. Conductive elements of Metal Traces 12 remain exposed on top of the HDI PCB 10.

FIGS. 5A and 5B show view of module resulting from the attaching steps in FIGS. 4A to 4C. FIG. 5A shows a view of the module for a side of the FPC 80 having Pads 84. FIG. 5B shows a view of the module for a back side of the FPC 80. As shown in FIG. 5C, the module for a HDI PCB 10 and FPC 80 of FIGS. 5A and 5B can be stacked with as many of the modules as needed to make a matrix array of desired dimensions. Modules can be formed with HDI PCB's 10 on both sides of a FPC 80. End modules can have a Kicker Material 94 mounted to respective FPC's 80. Kicker Material 94 can be used to extend the arrays, either to add a non-functional area, or to add electrical functions for Metal Traces 12. Pads 84 (not shown in FIG. 5C) on each FPC 80 can be used to connect to electronic or cable circuit assemblies.

The following are embodiments for techniques that can be used to manufacture a 2D Ultrasonic Transducer Array with the wiring configuration provided by a 2D Matrix Array Backing Interconnect Assembly, such as that shown in FIG. 5C.

[Second Embodiment]

To limit the amount of acoustic energy going into the backing interconnect assembly, it is desirable to have a much higher acoustic impedance material than the dielectric element (sound generator) between the backing interconnect assembly and a piezoelectric element. The piezoelectric material may be a PZT type (Lead-Zirconate-Titanate) or single crystal material such as PMN-PT type. These piezoelectric materials have a bulk acoustic impedance between 30-38 M Rayls, so a layer greater than twice this amount is suitable for limiting the amount of acoustic energy going into the backing interconnect. A suitable material is Tungsten or Tungsten Carbide, both having high acoustic impedance (>100 M Rayls) and both electrically conductive. The thickness of this high acoustic impedance layer impacts the response of the element and must be determined such that it does not degrade, but instead enhances the acoustic response of the element. Preferably, the thickness will be less than ½λ (wavelength) of the material. The backing layer must conduct electricity and provide an interconnection between a piezoelectric element and the PCB backing.

FIG. 6 shows a 2D Matrix Array Backing Interconnect Assembly with a Tungsten Backing Layer 102 as a High Impedance Backing Layer (HZ BL).

FIGS. 7A and 7B show steps in manufacturing a High Impedance Backing Layer (HZ BL) 112, 112*a* on a 2D Matrix Array Backing Interconnect Assembly 104 (such as that shown in FIG. 5C).

In FIG. 7A, the HZ BL 112 is attached to the 2D Matrix Array Backing Interconnect Assembly 104 with a conductive adhesive paste or film 106. The adhesive 106 must adhere well to both the HZ BL material and the backing material. The adhesive 106 must be strong enough to hold the HZ BL material to the backing and survive a dicing (cutting) operation that isolates the HZ BL into a matrix of single pads that will provide an electrical path between a piezoelectric element, an individual element, and to a metal trace; that is directly below the element in the backing.

In FIG. 7B, a dicing (cutting) process is performed to separate/isolate the electrically conductive HZ BL 112 (cross-section view 100 before cutting) into a matrix of individual, electrically isolated conductive pads 112*a* (cross-section view 110 after cutting). Cuts 108 are made between individual Metal Traces 12 to a predetermined cutting depth from the surface of the 2D Matrix Array Backing Interconnect Assembly 104 having the contact elements of Metal Traces 12.

[Third Embodiment]

Figure 8A:
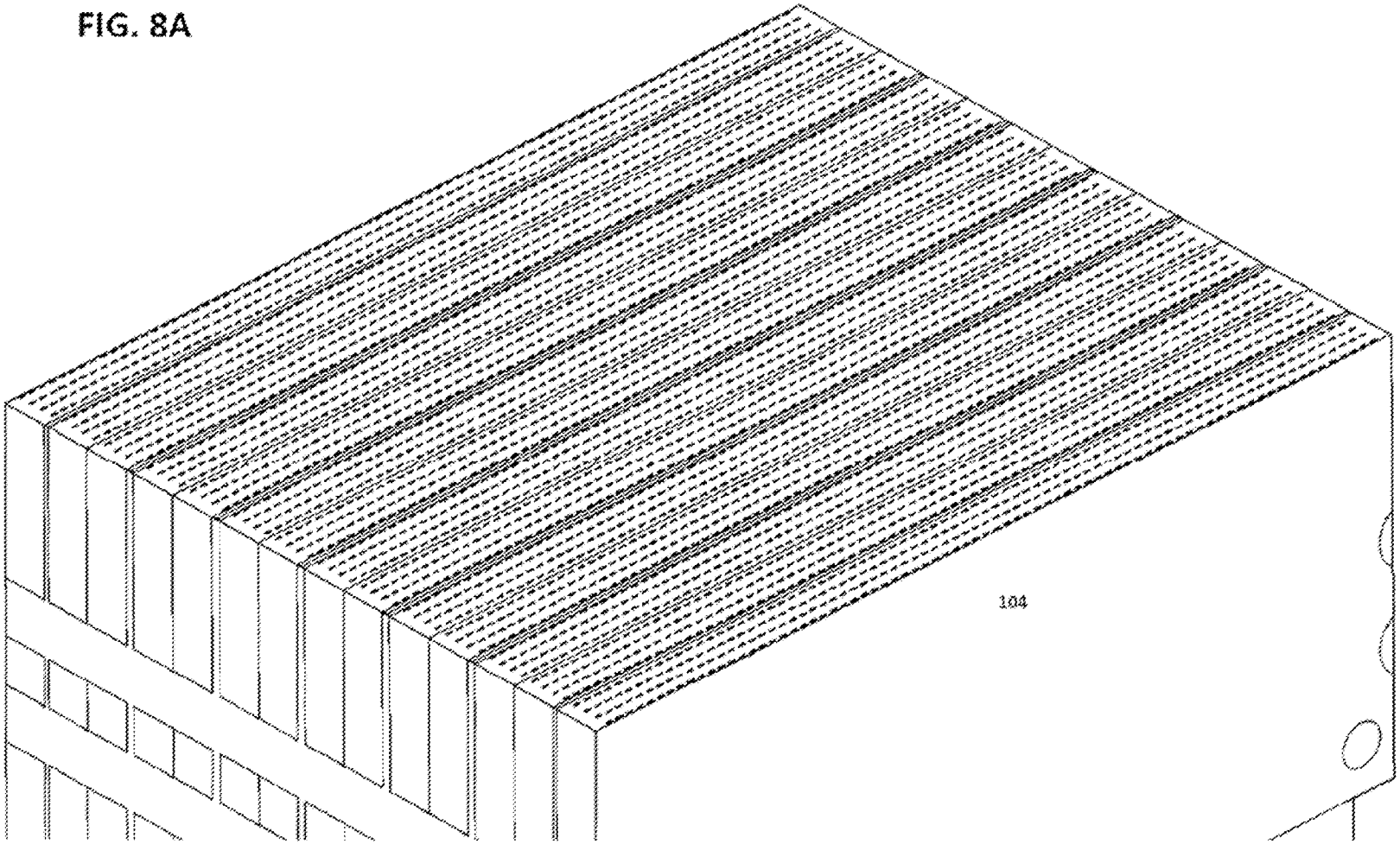

FIGS. 8A to 8D show steps in forming acoustic layers to form a 2D Ultrasonic Transducer. FIG. 8A shows a 2D Matrix Array Backing Interconnect Assembly 104 (such as that shown in FIG. 5C).

Figure 8B:
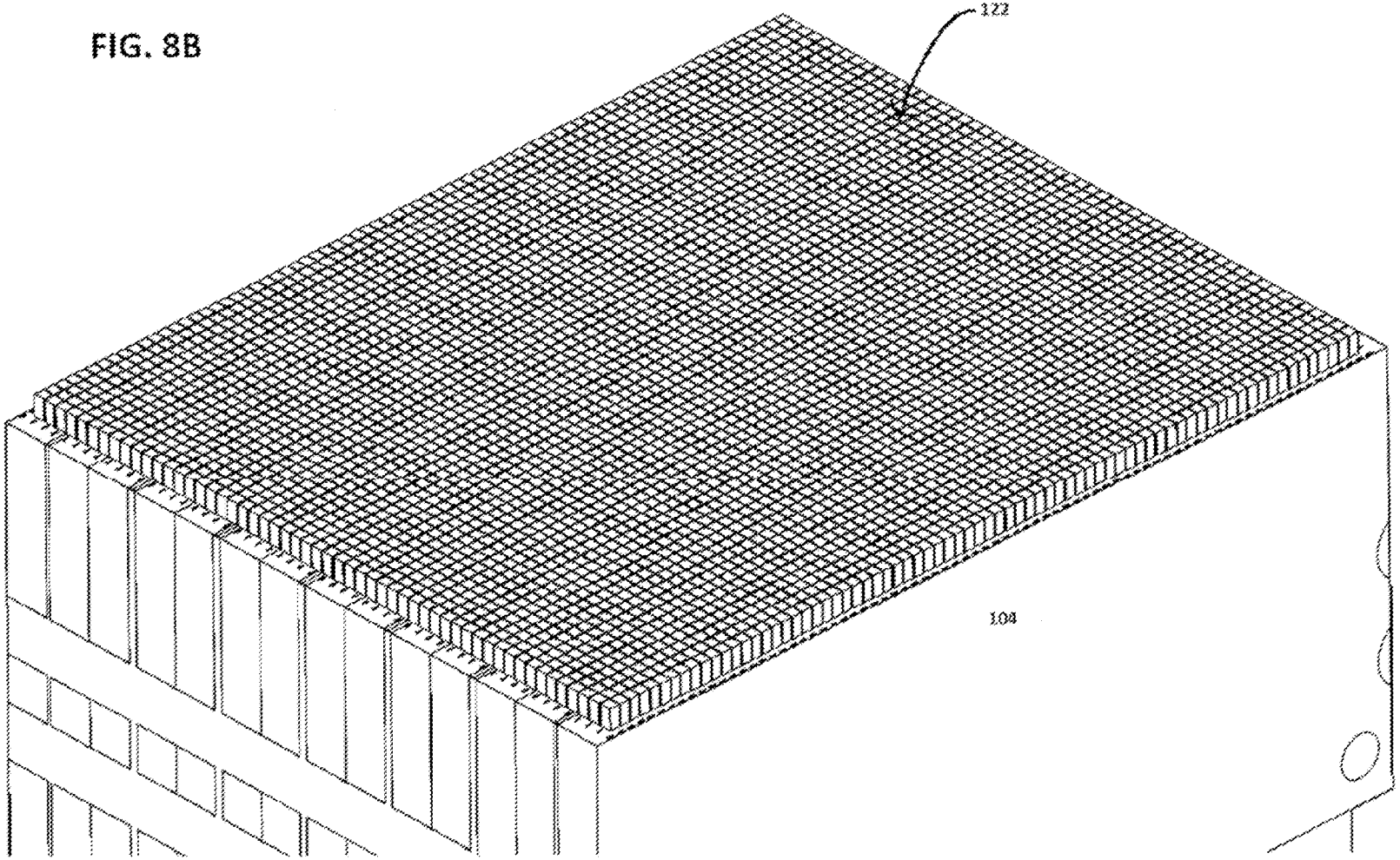

In FIG. 8B, a layer of Piezoelectric Elements 122 can be formed in contact with the contact elements of the Metal Traces 12 on the 2D Matrix Array Backing Interconnect Assembly 104.

The layer of piezoelectric elements 122 is used both as a transmitter, and as a receiver of ultrasonic energy, and can either convert ultrasonic energy into electricity or convert electricity into ultrasonic energy. Since the size of the elements in a 2D matrix array are much smaller than in conventional 1D array, that is in electrode area, a high dielectric piezoelectric material is preferred in order to keep the electrical impedance of the element within a usable range. An example of a high dielectric piezoelectric material is CTS's 3265 PZT (lead zirconate titanate). Another example high performance, high dielectric material is TRS Technologies's X2B piezoelectric material, a PMN-PT (lead magnesium niobate-lead titanate) type single crystal material which has 5×'s the strain energy density of a conventional piezoceramic.

Figure 8C:
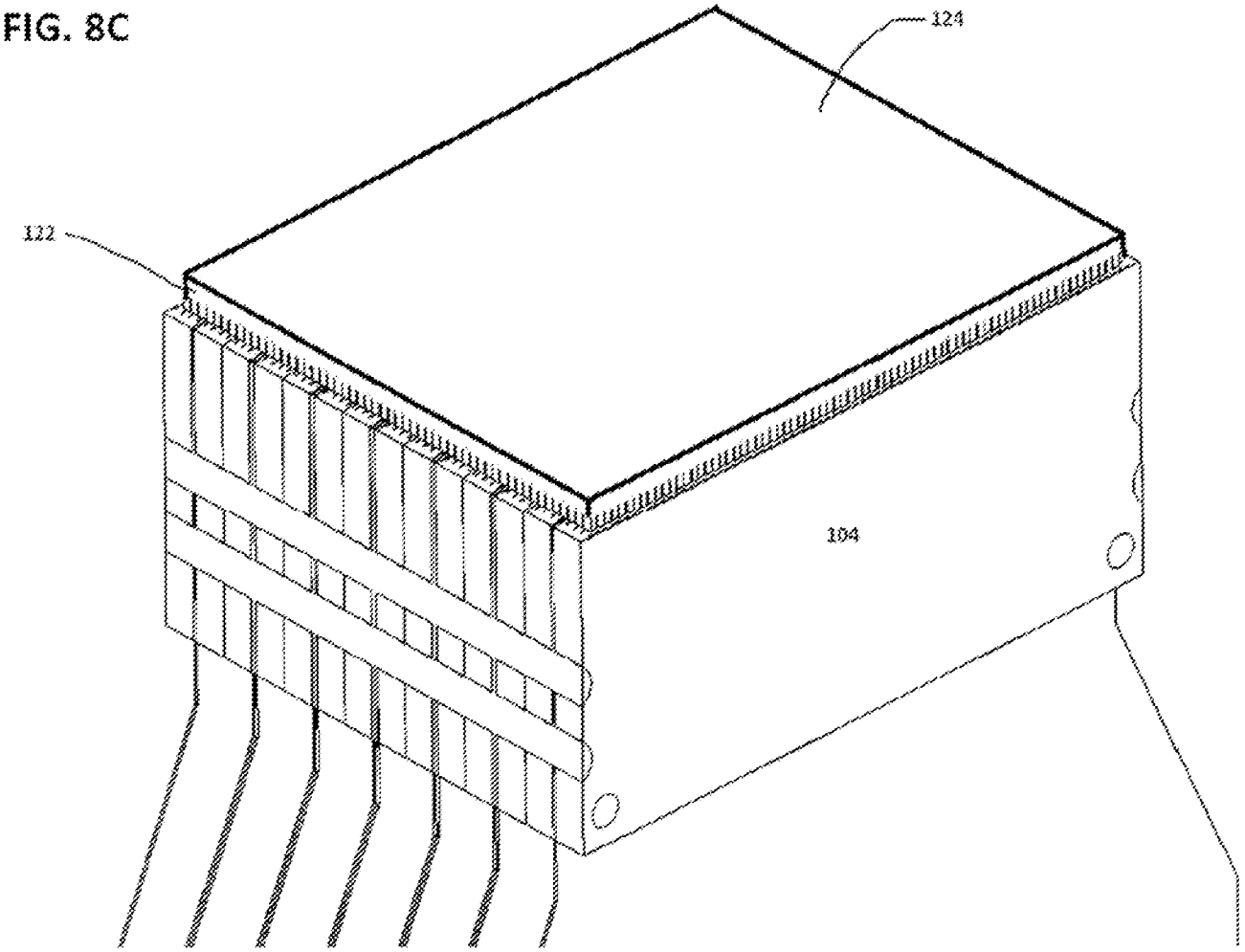

In FIG. 8C, an Acoustic Matching Layer 124 can be formed on the Piezoelectric Layer 122. The surface area of the Acoustic Matching Layer 124 in contact with the Piezoelectric Elements 122 contains a metal in order to provide a conductive path across the piezoelectric elements to a Perimeter Ground/Shield 126.

Figure 8D:
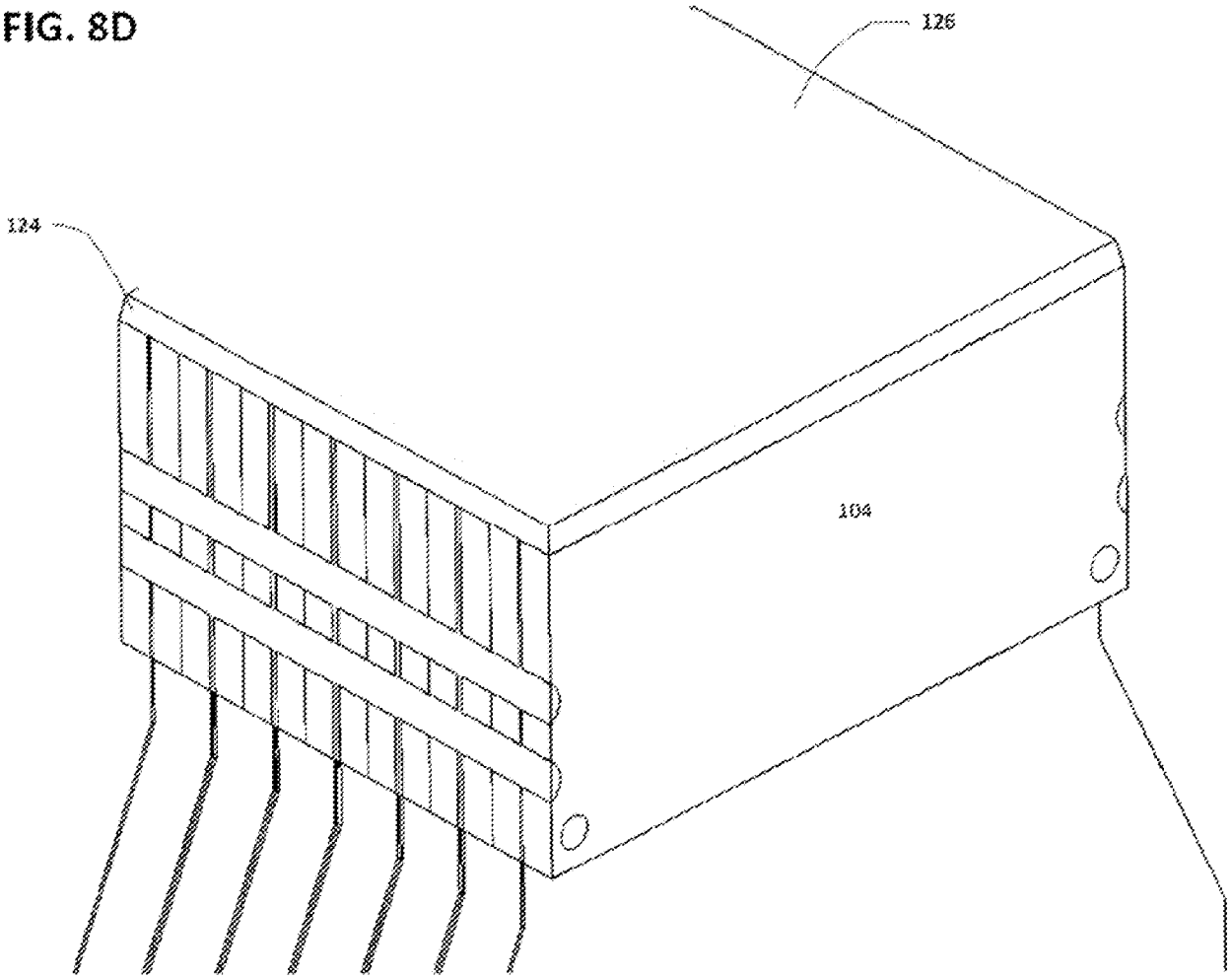

In FIG. 8D, a Perimeter Ground/Shield 126 is formed over the Acoustic Matching Layer 124, and is preferably made of an electrically conductive metal, such as silver epoxy.

[Fourth Embodiment]

In the second embodiment, a High Impedance Backing Layer (HZ BL) is added by applying an electrically conductive adhesive to the 2D Matrix Array Backing Assembly and attaching the Backing Layer by way of the adhesive. However, depending on the material used for the conductive adhesive and the thickness thereof, the exposed elements of the Metal Traces 12 at the surface of the 2D Matrix Array Backing Interconnect Assembly 104 can be raised to make them protrude above the surface of the Backing Assembly 104. In an example embodiment, shown in FIG. 9A, a Plated Bump 132 of Cu, Ni, Aw can be formed on exposed elements of the Metal Traces 12 (for example, Metal Traces made of Cu). See also FIG. 9B, showing a perspective view for the figure shown in FIG. 9A. As shown in FIG. 9C, the Plated Bumps 132 are formed to allow direct contact with the HZ BL through the conductive adhesive 92. The direct electrical contact between the Metal Traces 12 by way of Plated Bumps 132 to the HZ BL 112 provides a more reliable electrical contact.

In addition, as shown in FIG. 10, a slot 142 may be cut through the center of the Metal Traces 12 in each row of Metal Traces 12 including extending cutting of the slot 142 into the PCB's 14 in the Backing Assembly 104. The slot 142 allows the conductive adhesive 92 to anchor itself to the Backing Assembly 104 and creates a greater surface area for electrical contact.

After the HZ BL 112 has been attached to the 2D Matrix Array Backing Interconnect Assembly 104, additional slots 152, as shown in FIG. 11, can be cut through the HZ BL 112 and into the Backing Interconnect Assembly 104, in the region between Metal Traces 12. The slots 152 are preferably made just deep enough to prevent electrical continuity between Metal Traces 12.

As shown in FIG. 12, a tongue and groove technique can be applied. The technique of tongue and groove shown in FIG. 12 provides a substantial anchor for the HZ BL, specifically a Tungsten Carbide layer, to the 2D Matrix Array Backing Interconnect Assembly 104. The technique helps keep the HZ BL attached to the backing during a dicing process. The dicing process may be performed by cutting slots 154 between Metal Traces 12 to a predetermined cut depth 156 sufficient to separate/electrically isolate the electrical conductive HZ-BL into a matrix of individual, isolated conductive pads.

FIG. 13A shows the dicing process as including cutting of acoustic layers, such as an outer matching layer 166, an inner matching layer 164, piezoelectric layer 122, as well as the HZ BL 112, conductive adhesive 92, and into PCB's 14, to form acoustic elements 162 in the 2D Matrix Array Acoustic Assembly 160. As shown in FIG. 13B, a diced HZ BL 112*a* is anchored in slot 142 (see FIG. 10) by way of the tongue and groove technique.

[Fifth Embodiment]

In a further embodiment, as shown in FIG. 14A, an Acoustic Stack Module 172 can be manufactured separately, then attached to the HZ BL 112 arranged on the 2D Matrix Array Backing Interconnect Assembly 104 to obtain the 2D Matrix Array Acoustic Assembly shown in FIG. 4C. The Acoustic Stack Module 172 can be formed as a Piezoelectric layer 122, an inner matching layer 164, and an outer matching layer 166. As shown in FIG. 14B, the Acoustic Stack Module 172 can be attached to the HZ BL 112 and 2D Matrix Array Backing Interconnect Assembly 104 by non-conductive adhesive 168 applied to slots 154 between Metal Traces 12.

The separate manufacturing of an Acoustic Stack Module 172 allows for simplification in manufacturing of Ultrasonic Acoustic Transducer Devices, as well as allows for improvements in the Acoustic Stack Module 172 independent of the separately manufactured 2D Matrix Array Backing Interconnect Assemblies.

[Sixth Embodiment]

Figures 15A, 15B:
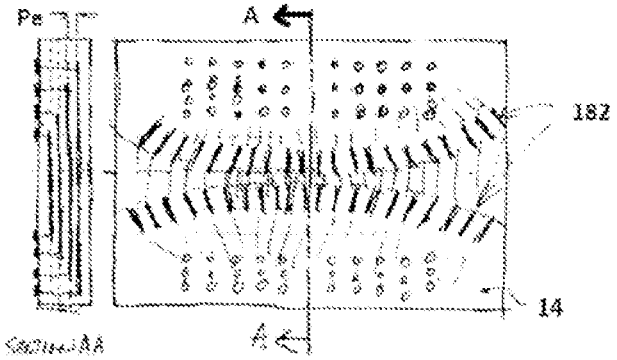

Embodiments for the 2D Matrix Array Backing Interconnect Assembly can be adopted for a Curvilinear Ultrasonic Transducer. The 2D Matrix Array Backing Interconnect Assembly can be formed to accommodate metal traces on a radial layout. FIG. 15A shows an example of metal traces formed in a radial layout 182 in a HDI PCB. FIG. 15B shows a cross-section of the arrangement in FIG. 15A.

Figure 15C:
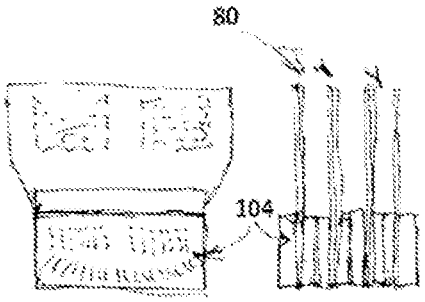
Figure 15D:
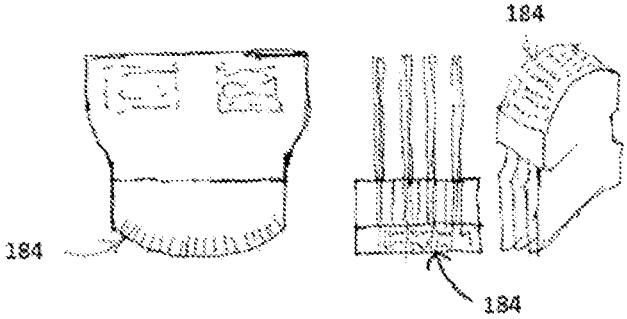

Provided the HDI PCB having the radial layout of metal traces of FIG. 15A, in FIG. 15C, HDI PCB's can be laminated to FPC's to form a stack in a similar manner as before in FIG. 5C. As shown in FIG. 15D, the surface of the stacked HDI PCB/FPC's can be machined into a curved surface 184 to expose the radial metal traces. An Acoustic Stack Module matching the curved shape of the curved surface 184 can be attached to the Curved 2D Matrix Array to form a Curvilinear Ultrasonic Transducer.

Although an example 2D Matrix Array Backing Interconnect Assembly is illustrated in the drawings, the number and size of the HDI PCB's and FPC's are not limited as such. Also, an example Acoustic Stack with acoustic layers has been disclosed. The 2D Matrix Array Backing Interconnect Assembly can be attached with other types of acoustic modules to form ultrasonic transducers.

The scope of the present disclosure should include such modifications as defined by the scope of the appended claims.

That which is claimed:

1. A method of producing a two dimensional matrix array backing interconnect assembly, comprising:

forming a plurality of high density interconnect printed circuit boards, each high density interconnect printed circuit board having a plurality of alternating layers of a dielectric layer and a lamination material, each dielectric layer having an array of metal traces, wherein a two dimensional matrix of electrically conductive pads is formed on an outermost surface of the high density interconnect printed circuit board that is parallel to an array of the metal traces, wherein the metal traces are internally connected one-to-one to each of the electrically conductive pads by way of electrically conductive through-holes, wherein an end of the metal traces are exposed at a surface of the alternating layers to form respective conductive elements;

forming a plurality of flexible printed circuits, each flexible printed circuit having at least one two dimensional array of electrically conductive pads, wherein one of the two dimensional matrix of pads corresponds one-to-one to the two dimensional matrix of electrically conductive pads is formed on the outermost surface of one of the high density interconnect printed circuit boards, each flexible printed circuit having at least one secondary two dimensional array of electrically conductive pads in a section of the flexible printed circuit that is separate from a section having the at least one two dimensional array of electrically conductive pads;

attaching one said flexible printed circuit to a first one said high density interconnect printed circuit board so that the corresponding two dimensional matrix of pads line up one-to-one;

repeating said attaching of one flexible printed circuit to one said high density interconnect printed circuit board for each of the plurality of flexible printed circuits and each of the plurality of said high density interconnect printed circuit boards to form interconnect modules; and attaching the interconnect modules to form a two dimensional matrix array backing interconnect assembly.

2. The method of claim 1, wherein said attaching includes attaching a second one said high density interconnect printed circuit board to an opposite side of said one flexible printed circuit, opposite to the side that the first one said high density interconnect printed circuit board has been attached, the attaching being such that one said flexible printed circuit is attached to the second one said high density interconnect printed circuit board so that the corresponding two dimensional matrix of pads line up one-to-one with respect to a two dimensional matrix of pads formed on said opposite side of said one flexible printed circuit; and said step of repeating said attaching for each of the plurality of flexible printed circuits and each of the plurality of said high density interconnect printed circuit boards to form interconnect modules each having one flexible printed circuit with two high density printed circuit boards attached thereto.

3. The method of claim 1, wherein said attaching one said flexible printed circuit to a first one said high density interconnect printed circuit board is performed by applying a conductive adhesive.

4. The method of claim 1, wherein said attaching one said flexible printed circuit to a first one said high density interconnect printed circuit board is performed by an ohmic connection between corresponding pads.

5. A method of producing a two dimensional ultrasonic transducer array, comprising:

forming a plurality of high density interconnect printed circuit boards, each high density interconnect printed circuit board having a plurality of alternating layers of a dielectric layer and a lamination material, each dielectric layer having an array of metal traces, wherein a two dimensional matrix of electrically conductive pads is formed on an outermost surface of the high density interconnect printed circuit board that is parallel to an array of the metal traces, wherein the metal traces are internally connected one-to-one to each of the electrically conductive pads by way of electrically conductive through-holes, wherein an end of the metal traces are exposed at a surface of the alternating layers to form respective conductive elements;

forming a plurality of flexible printed circuits, each flexible printed circuit having at least one two dimensional array of electrically conductive pads, wherein one of the two dimensional matrix of pads corresponds one-to-one to the two dimensional matrix of electrically conductive pads is formed on the outermost surface of one of the high density interconnect printed circuit boards, each flexible printed circuit having at least one secondary two dimensional array of electrically conductive pads in a section of the flexible printed circuit that is separate from a section having the at least one two dimensional array of electrically conductive pads;

attaching one said flexible printed circuit to a first one said high density interconnect printed circuit board so that the corresponding two dimensional matrix of pads line up one-to-one;

repeating said attaching of one flexible printed circuit to one said high density interconnect printed circuit board for each of the plurality of flexible printed circuits and each of the plurality of said high density interconnect printed circuit boards to form interconnect modules;

attaching the interconnect modules to form a two dimensional matrix array backing interconnect assembly;

applying a backing layer, made of a material having a higher acoustic impedance than the two dimensional matrix array backing interconnect assembly, on a surface of the two dimensional matrix array backing interconnect assembly having the exposed conductive elements of the metal traces;

applying a piezoelectric layer on the backing layer; and applying one or more acoustic matching layers on the piezoelectric layer to form a two dimensional ultrasonic transducer array.

6. The method of claim 5, further comprising in said applying the backing layer, producing plated bumps on the exposed conductive elements of the metal traces in order to form conductive protrusions for the metal traces, cutting shallow slots through the center of each row of metal traces through the conductive protrusions, and using a tongue and groove technique, applying the backing layer on said surface of the two dimensional matrix array backing interconnect assembly having the exposed conductive elements of the metal traces.

7. The method of claim 5, further comprising cutting slots in between metal traces through the acoustic matching layers, the piezoelectric layer, the backing layer and into the 2D matrix array backing interconnect assembly, to a depth sufficient to extend electrical isolation between individual metal traces to the uppermost surface of the 2D ultrasonic transducer array, to form a 2D array of ultrasonic transducers.

8. The method of claim 5, wherein the one or more acoustic matching layers are applied to the piezoelectric layer to form an acoustic stack that is attached as a unit to the backing layer.

9. The method of claim 5, wherein each high density interconnect printed circuit board is formed such that an end of the metal traces at each row parallel to the surface of an attached flexible printed circuit are exposed only in a center column, and form a radial arrangement in depth from the surface in both directions along each array of metal traces beginning at the center column, said method further comprising machining the surface to form a radial surface that exposes ends of the arrays of metal traces, and applying the backing layer, the piezoelectric layer, and the one or more acoustic matching layers to form a curvilinear transducer array.

* * * * *